US007913811B2

(12) United States Patent
Andre et al.

(10) Patent No.: US 7,913,811 B2
(45) Date of Patent: Mar. 29, 2011

(54) MUFFLER AND CORRESPONDING MANUFACTURING PROCESS

(75) Inventors: Joachim Andre, Schwalbach (DE); Norbert Schug, Herschweiler (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 0 days.

(21) Appl. No.: 12/609,362

(22) Filed: Oct. 30, 2009

(65) Prior Publication Data

US 2010/0116586 A1 May 13, 2010

(30) Foreign Application Priority Data

Nov. 7, 2008 (DE) ..... 10 2008 056 350

(51) Int. Cl.
*F01N 13/18* (2010.01)
*B21D 51/16* (2006.01)
*F01N 13/00* (2010.01)
*B21D 51/00* (2006.01)

(52) U.S. Cl. ..... 181/282; 181/243; 29/890.08

(58) Field of Classification Search ..... 181/282, 181/272, 275, 243; 29/890.08
See application file for complete search history.

(56) References Cited

U.S. PATENT DOCUMENTS

| | | | | | |
|---|---|---|---|---|---|
| 2,107,588 | A * | 2/1938 | Smith | 181/243 |
| 2,457,890 | A * | 1/1949 | Hedrick | 181/238 |
| 2,961,059 | A * | 11/1960 | Blair | 181/238 |
| 3,042,138 | A * | 7/1962 | Reinert | 181/241 |
| 3,262,189 | A * | 7/1966 | Ross et al. | 29/890.08 |
| 3,324,533 | A * | 6/1967 | Watteau | 29/890.08 |
| 3,479,145 | A * | 11/1969 | Lentz | 422/181 |
| 3,709,320 | A * | 1/1973 | Hollerl et al. | 181/240 |
| 4,064,963 | A * | 12/1977 | Kaan et al. | 181/244 |
| 4,133,479 | A * | 1/1979 | Musitano et al. | 237/12.3 A |
| 4,486,932 | A * | 12/1984 | Hall et al. | 29/890.08 |
| 4,689,952 | A * | 9/1987 | Arthur et al. | 60/313 |
| 4,949,807 | A * | 8/1990 | Hirata et al. | 181/240 |
| 4,972,921 | A * | 11/1990 | Takada et al. | 181/282 |
| 5,259,797 | A * | 11/1993 | Miles et al. | 440/89 R |
| 6,076,632 | A * | 6/2000 | Schuhmacher et al. | 181/282 |
| 6,241,044 | B1 * | 6/2001 | Nishiyama et al. | 181/272 |
| 6,405,827 | B1 * | 6/2002 | Church | 181/243 |
| 6,581,723 | B2 * | 6/2003 | Brandt et al. | 181/256 |
| 7,104,359 | B1 * | 9/2006 | Zelinski | 181/264 |
| 7,316,292 | B2 * | 1/2008 | Morales et al. | 181/282 |
| 7,549,508 | B2 * | 6/2009 | Okawara et al. | 181/227 |
| 2005/0077104 | A1 * | 4/2005 | Flintham | 181/243 |
| 2005/0284691 | A1 * | 12/2005 | Voss et al. | 181/255 |
| 2009/0282820 | A1 * | 11/2009 | Hill et al. | 60/323 |

* cited by examiner

*Primary Examiner* — Edgardo San Martin
(74) *Attorney, Agent, or Firm* — McGlew and Tuttle, P.C.

(57) ABSTRACT

A muffler (1) for an exhaust system of an internal combustion engine, especially of a motor vehicle, with a housing (2), which has a jacket (3) and an end bottom each at two mutually spaced longitudinal ends of the jacket (3). At least one jacket opening (7) is provided, which passes through the jacket (3) and through which an inner tube (8) arranged in the interior of housing (2) can be connected to a tube of the exhaust system. The manufacture of the muffler (1) can be simplified if the jacket (3) is segmented in the circumferential direction (5) and has a jacket segment (11), which is manufactured as a separate component in relation to the remaining jacket (12). The separate component jacket segment (11) is rigidly connected to the remaining jacket (12) and has the at least one jacket opening (7).

23 Claims, 3 Drawing Sheets

MUFFLER AND CORRESPONDING MANUFACTURING PROCESS

CROSS REFERENCE TO RELATED APPLICATIONS

This application claims the benefit of priority under 35 U.S.C. §119 of German Patent Application DE 10 2008 056 350.1 filed Nov. 7, 2008, the entire contents of which are incorporated herein by reference.

FIELD OF THE INVENTION

The present invention pertains to a muffler for an exhaust system of an internal combustion engine, especially of a motor vehicle. In addition, the present invention pertains to a process for manufacturing such a muffler.

BACKGROUND OF THE INVENTION

A muffler may be designed as a jacketed embodiment for certain intended uses. In this case, it has a housing, which has a jacket and two end bottoms, which are arranged at two mutually spaced longitudinal ends of the jacket. Depending on the installation situation, the muffler may have at least one jacket opening, which passes through the jacket and through which an inner tube arranged in the interior of the housing can be connected to a tube of the exhaust system. Such a configuration may be advantageous, for example, if the muffler is arranged transversely in the mounted state. In addition, provisions may now also be made for providing at least one of the end bottoms with a bottom opening, through which another tube arranged in the interior space of the housing can be connected to another tube of the exhaust system.

The embodiment of the jacket opening and the embodiment of the connection through the jacket opening is problematic in mufflers of a jacketed design. To make the connection gas-tight, it is desirable to arrange the inner tube such that it is led from the inside through the jacket opening to the outside, so that it is accessible and, for example, can be welded from the outside. However, this makes it difficult to introduce the interior tube into a prefabricated jacket. A later attachment of the jacket is likewise complicated.

SUMMARY OF THE INVENTION

The present invention pertains to the object of proposing an improved embodiment for a muffler of the type mentioned in the introduction and for a corresponding manufacturing process, which embodiment is characterized especially in that the muffler can be manufactured in a comparatively simple manner.

According to the invention, a muffler is provided for an exhaust system, particularly for a motor vehicle internal combustion engine. The muffler comprises a housing with a jacket with an end bottom at each of two mutually spaced longitudinal ends of jacket. The jacket has at least one jacket opening passing through the jacket. An inner tube is arranged in the interior of housing. The jacket opening is for connecting the inner tube to a tube of the exhaust system. The jacket is segmented in a circumferential direction and comprises a jacket segment and a remaining jacket. The jacket segment is manufactured as a separate component in relation to the remaining jacket. The separate component jacket segment is rigidly connected to the remaining jacket and has the at least one jacket opening.

The present invention is based on the general idea of forming at least one jacket opening on a jacket segment, which forms a separate component in respect to the remaining jacket. The inner tube can thus be joined to this jacket segment in order to embody a connection of high quality between the inner tube and the jacket opening. A unit, which can be completely preassembled and can be subsequently complemented with the remaining jacket, is created as a result. Since the jacket segment extends only along a part of the circumference of the jacket, handling during manufacture is extremely simplified, so that it is possible, in particular, to use simpler and less expensive manufacturing tools.

Corresponding to a special embodiment, at least one intermediate bottom, which is fastened from the inside to an inner side of the jacket segment, which inner side faces the interior of the housing, may be arranged in the interior of the housing. Fastening performed from the inside between the bottom and the jacket segment can be embodied with a considerably higher quality and reliability than a connection to be prepared from the outside. This is made possible by the fact that the remaining jacket is attached only at a later point in time, so that the inner side of the jacket segment is readily accessible during the manufacture of the aforementioned unit.

Corresponding to another advantageous embodiment, the jacket segment may have a collar, which is formed integrally thereon, projects to the outside and borders the jacket opening, and, in addition, the inner tube may axially protrude into the collar and end, for example, more or less flush with same. A gas-tight connection can be established by these measures between the inner tube and the collar in an especially simple manner, as a result of which the jacket opening can be sealed in an especially simple manner and with an especially high quality. At the same time, the connection to the exhaust system can also be embodied in a simple and gas-tight manner due to this mode of construction. For example, a tube of the exhaust system can be inserted into or attached to the inner tube and rigidly and tightly connected to the inner tube and/or to the collar by means of a circumferential weld seam.

It is apparent that the above-described features, which will also be explained below, can be used not only in the particular combination described, but in other combinations or alone as well, without going beyond the scope of the present invention.

Preferred exemplary embodiments of the present invention are shown in the drawings and will be explained in more detail in the following description, where identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
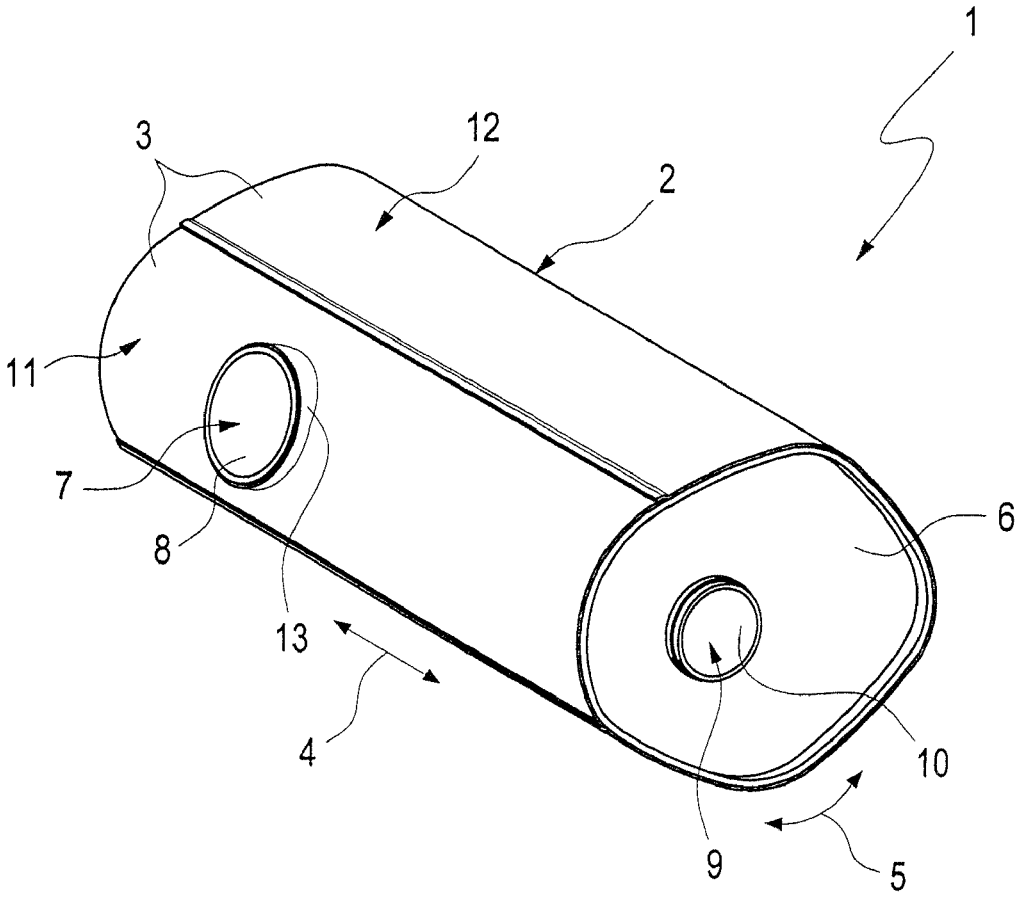
FIG. 1 is a perspective view showing a muffler according to the invention.

Referring to the drawings in particular, corresponding to FIGS. 1 through 6, a muffler 1, which is suitable for being integrated into an exhaust system, not shown here, of an internal combustion engine, especially of a motor vehicle, comprises a housing 2 of a jacket type design. The housing 2 correspondingly has a jacket 3, which extends in a longitudinal direction 4 and in a circumferential direction 5. The housing 2 has, furthermore, two end bottoms, or end pieces, 6, which are arranged at mutually spaced longitudinal ends of the jacket 3. The housing 2 has at least one jacket opening 7, which passes through the jacket 3 and forms an exhaust gas inlet or an exhaust gas outlet. An inner or radial tube 8 arranged in the interior of housing 2 can be connected by said jacket opening 7 to a tube of the exhaust system, which said tube is not shown here. The housing 2 has at least one additional opening. This at least one additional opening is designed in the preferred example as a bottom opening 9, which passes through one of the end bottoms, or end pieces, 6 and through which another tube 10 arranged in the interior of housing 2 can likewise be connected to another tube of the exhaust system. This bottom opening 9 maybe, complementary to the jacket opening 7, an exhaust gas outlet or an exhaust gas inlet. Two such bottom openings, which may be formed at the same end bottom 6 or are preferably arranged each on one of the end bottoms 6, may be present, in principle. Only a single jacket opening 7 is preferably formed on the housing 2. For example, the muffler 2 may be designed as a rear muffler. It is especially suitable for transverse mounting on the underbody of the vehicle.

The jacket 3 is segmented in the circumferential direction 5, so that it has at least two jacket segments, namely, a first jacket segment 11 and a second jacket segment 12. The first jacket segment 11 has the jacket opening 7 and will hereinafter be called jacket segment 11 for simplicity's sake. The second jacket segment 12 forms the remaining jacket 3 and will hereinafter be called remaining jacket 12. The jacket segment 11 is designed as a separate component relative to the remaining jacket 12. The jacket segment 11 and the remaining jacket 12 are rigidly connected to one another in the mounted state, which is shown in FIG. 1. The remaining jacket 12 preferably has no jacket opening. If a plurality of jacket openings 7 are present, these are all preferably formed in jacket segment 11.

Jacket segment 11 may have, corresponding to the embodiments being shown here, a collar 13, which projects to the outside relative to the rest of the outer contour of the jacket segment 11 and which borders the jacket opening 7. Collar 13 is made integrally in one piece with the jacket segment 11. The jacket segment 11 may be designed especially as a shaped sheet metal part, especially as a deep-drawn part. The inner or radial tube 8 associated with the jacket opening 7 protrudes coaxially into the jacket opening 7. The inner or radial tube 8 ends more or less flush with the collar 13 in the example. The inner tube 8 may be rigidly connected to the collar 13 in the mounted state. An annular, closed circumferential weld seam is suitable for this. In an inner tube 8 slightly projecting over the collar 13, this seam may connect a front side of collar 13 to the outer side of the inner tube 8. The jacket segment 11 is preferably made in one piece here.

A process for manufacturing the muffler 1 will be described in more detail below with reference to FIGS. 2 through 6. Other features of the muffler 1 will be explained in more detail.

Figure 2:
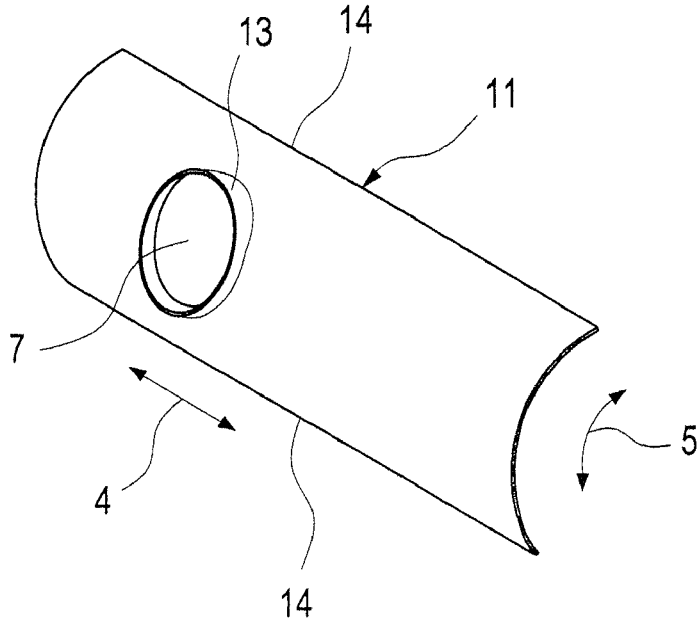
FIG. 2 is a perspective view of a jacket segment of the muffler.

According to FIG. 2, the jacket segment 11 is manufactured separately from the remaining jacket 12 or is separated from same. At any rate, the jacket segment 11 and the remaining jacket 12 are separate components after their manufacture. A one-part manufacture of the jacket segment 11 as a shaped sheet metal part is preferable. As can be recognized, collar 13 is made integrally in one piece with the jacket segment 11. The jacket segment 11 preferably extends over between 10% and 40% of the overall circumference of the jacket 3. It extends over about 20% of the overall length of the jacket 3 in the example. As can be recognized, circumferential ends 14 of jacket segment 11 always extend in a straight line. They preferably extend in parallel to the longitudinal direction 4 of the jacket 3.

Figure 3:
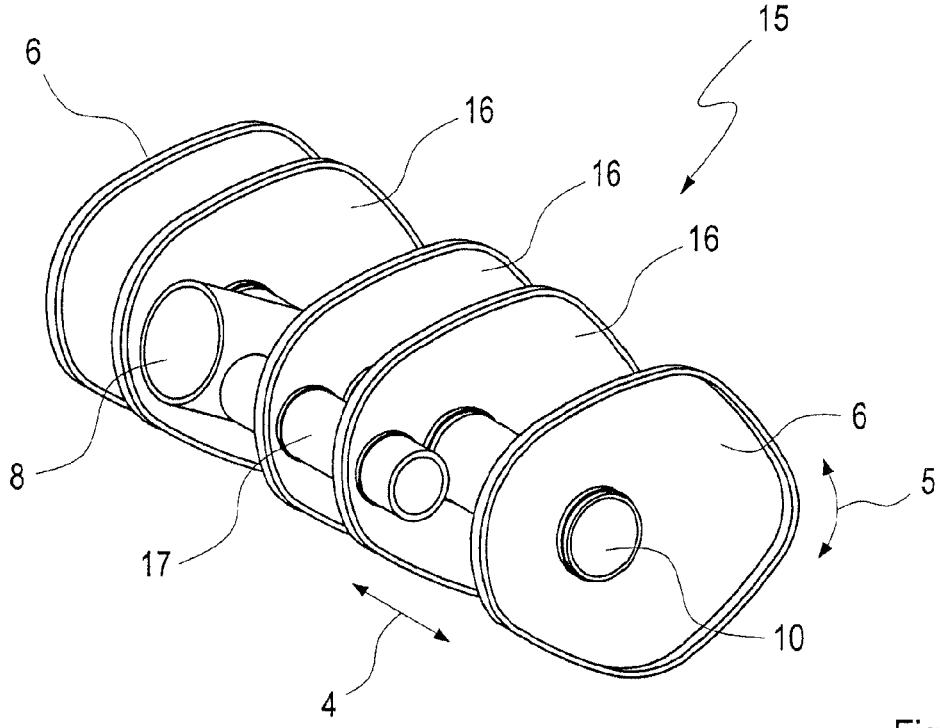
FIG. 3 is a perspective view of an insert of the muffler.

An insert 15, shown in FIG. 3, which comprises at least the inner or radial tube 8 and the two end bottoms 6, is manufactured separately from jacket segment 11 and separately from the remaining jacket 12. FIG. 3 shows a comparatively complex insert 15, which also comprises an internal arrangement having at least three intermediate bottoms 16, the additional inner tube 10 as well as at least one connection tube 17. A plurality of chambers, which may be designed as reflection chamber, absorption chamber and resonance chamber as well as any desired combinations thereof, may be formed by means of this insert 15 in the interior of housing 2. Insert 15 can be completely preassembled per se.

Figure 4:
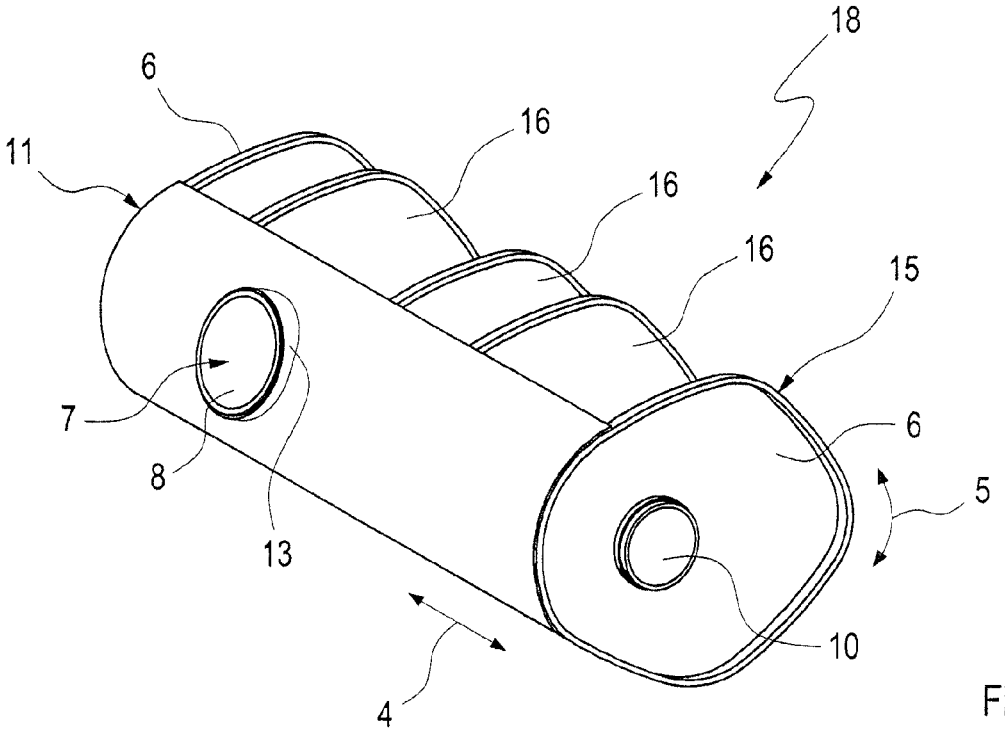
FIG. 4 is a perspective view of a prefabricated unit of the muffler.

According to FIGS. 3 and 4, the completely preassembled insert 15 may be rigidly connected to the jacket segment 11 in order to form a unit 18, which can be completely preassembled. Mounting of the jacket segment 11 on the insert 15 is comparatively simple, because positional tolerances, in particular, can be compensated in an especially simple manner. Furthermore, the inner tube 8 can be passed through the jacket opening 7 and connected to the collar 13 in an especially simple manner. The end bottoms 6 can also be connected to the jacket segment 11 in a simple manner, and shape tolerances and positional tolerances can be compensated in a simple manner in this case as well. According to FIG. 4, it is easy to recognize that an inner side of the jacket segment 11 facing the interior of the housing 2 is easily accessible in this unit 18 because of the absence of the remaining jacket 12. Consequently, the intermediate bottoms 16, for example, can be attached to the jacket segment 11 from the inside. For example, the intermediate bottoms 16 can be welded to the inner side of the jacket segment 11. The unit 18 acquires an especially high stability as a result.

Figure 5:
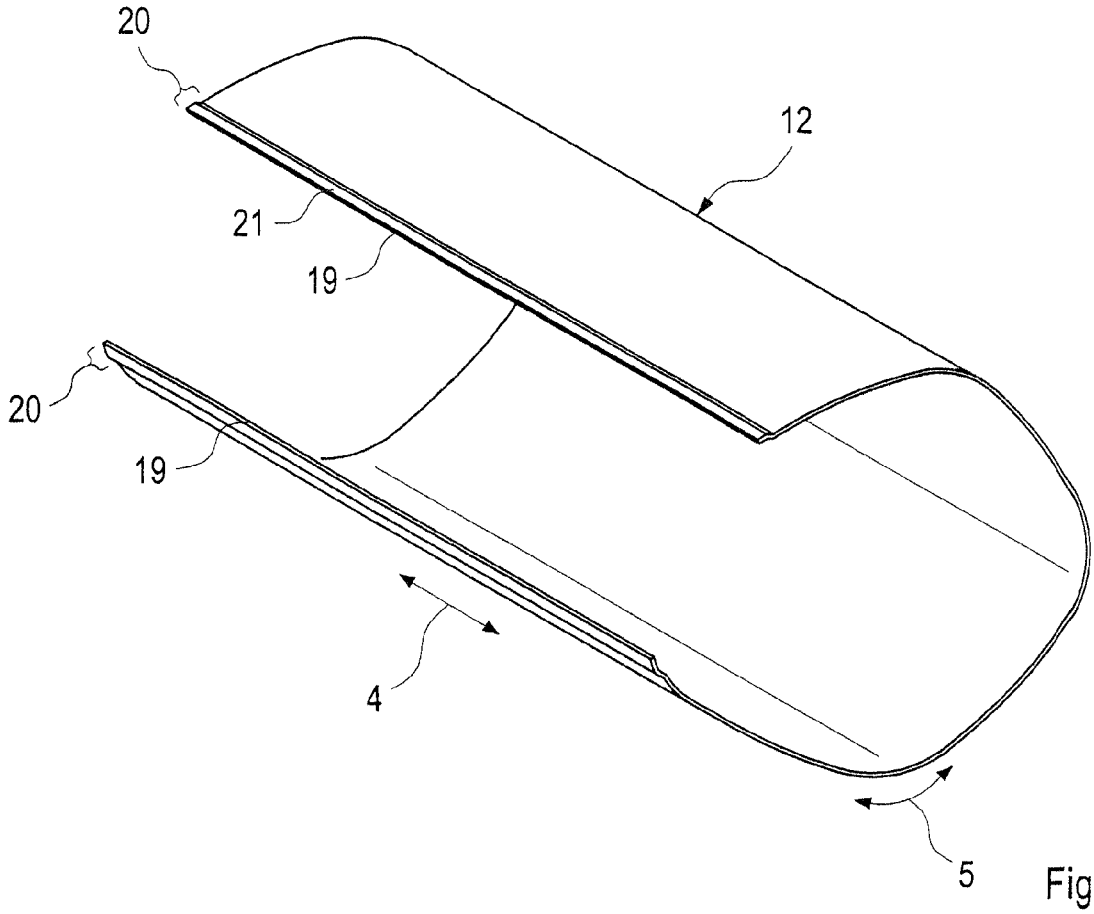
FIG. 5 is a perspective view of another jacket segment of the muffler.

Corresponding to FIG. 5, the remaining jacket 12 is manufactured separately from the jacket segment 11 and separately from insert 15. This is likewise preferably a shaped sheet metal part, which is preferably manufactured from one piece. The remaining jacket 12 likewise has, complementarily to the jacket segment 11, straight circumferential ends 19, which preferably extend in parallel to the longitudinal direction 4 of jacket 3. Especially advantageous here is an embodiment in which the remaining jacket 12 is larger in the circumferential direction 5 than the difference between the overall circumference of the jacket 3 and the circumferential portion of the jacket segment 11. An overlapping area 20 each, which overlaps the jacket segment 11 at the circumferential ends 14 thereof in the circumferential direction 5, can be embodied hereby at the circumferential ends 19 of the remaining jacket 12. To make it possible to make this overlap as gas-tight as possible and to prepare it in as simple a manner as possible, the jacket segment 11 or, like here, the remaining jacket 12 may have an outwardly stepped edge 21 each at its circumferential ends 19. The step height of the stepped edge 21 is coordinated with the thickness of the material of jacket segment 11. Besides, the overlapping area 20 makes it possible to compensate tolerances during the mounting of the remaining jacket 12.

Figure 6:
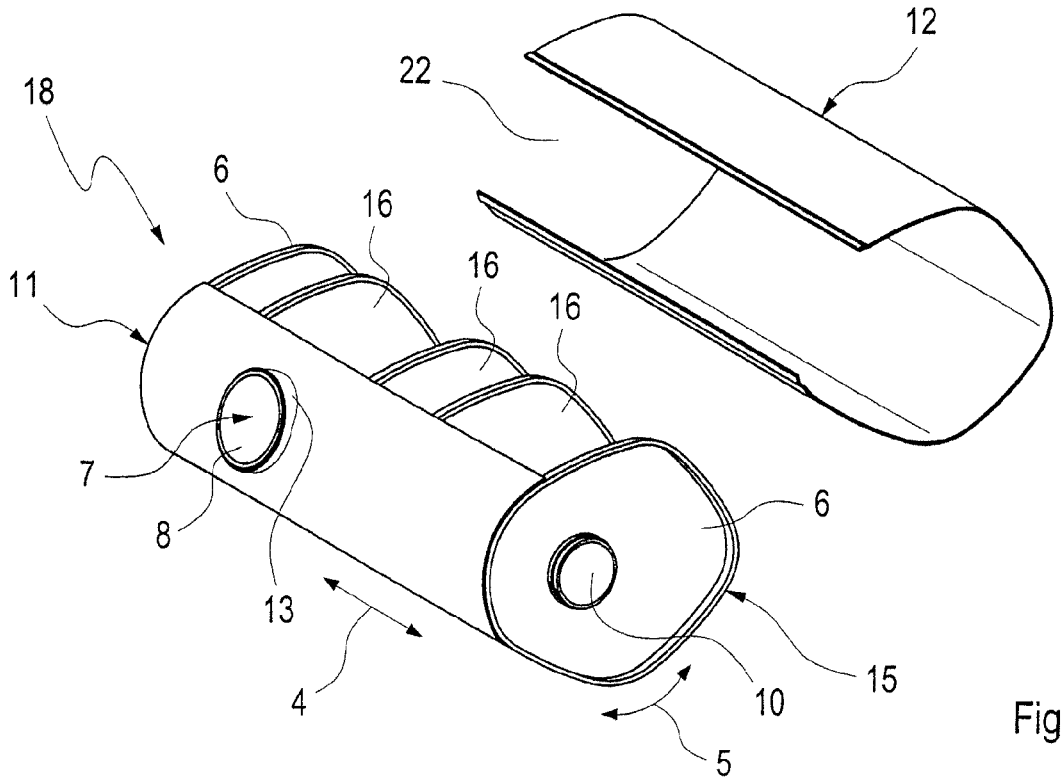
FIG. 6 is a perspective view of the muffler during the mounting of the other jacket segment on the preassembled unit.

The remaining jacket 12, which may be preformed corresponding to the circumferential contour of the jacket 3 or corresponding to the circumferential contour of unit 18, is attached to unit 18 corresponding to FIG. 6. The remaining jacket 12 may be attached for this at right angles to the longitudinal direction 4, and the open side 22 formed by the missing jacket segment 11 is pulled over unit 18. This is readily possible due to the flexibility of the jacket material used. The remaining jacket 12 is positioned now at unit 18 such that the overlapping areas 20 overlap the circumferential ends 14 of the jacket segment 11. The remaining jacket 12 can subsequently be attached. For example, the remaining jacket 12 may be rigidly connected to the jacket segment 11 along the stepped edges 21. For example, a weld seam prepared from the outside may be provided. Furthermore, the remaining jacket 12 is rigidly connected to the end bottoms 6, for example, by means of weld seams. Moreover, the remaining jacket 12 may be additionally connected rigidly to at least one of the intermediate bottoms 16 from the outside. For example, tack welds prepared from the outside may connect the remaining jacket 12 from the outside to the intermediate bottoms 16 arranged on the inside.

The muffler according to FIG. 1 is now obtained after attaching the remaining jacket 12.

Besides, it is possible due to the segmenting of the jacket 3 in the circumferential direction 5 to vary the material thicknesses or wall thicknesses of the jacket 3 in the individual segments. Thus, the jacket segment 11 and the remaining segment 12 may have different wall thicknesses. For example, the jacket segment 11 has a greater wall thickness than the remaining jacket 12. For example, the wall thickness of the jacket segment 11 may be at least 50% of or at least twice the wall thickness of the remaining jacket 12. As a result, the jacket segment 11 can be provided with greater dimensional stability, which increases the rigidity of unit 18. At the same time, the muffler 1 is optimized in terms of weight and manufacturing costs. In addition or as an alternative, it is possible to use different materials for the jacket segment 11 and the remaining jacket 12. Adaptation to different requirements, e.g., strength, stiffness, is made possible hereby as well.

In addition or as an alternative, it is possible due to the segmentation in a relatively simple manner to provide the jacket segment 11 or the remaining jacket 12 or both the jacket segment 11 and the remaining jacket 12 with stiffening beads, which are not shown here. The stability of the jacket or of housing 2 can be significantly increased hereby. The beads preferably extend in the circumferential direction 5. They may be arranged especially such that they can be used to position the intermediate bottoms 16 and/or the end bottoms 6, e.g., in the form of groove-like depressions on the inner side of the jacket segment 11 and of the remaining jacket 12.

While a specific embodiment of the invention has been described in detail to illustrate the application of the principles of the invention, it will be understood that the invention may be embodied otherwise without departing from such principles.

What is claimed is:

1. A muffler for an exhaust system for a motor vehicle internal combustion engine, the muffler comprising:

a housing with a jacket;

an end bottom at each of two mutually spaced longitudinal ends of jacket, said end bottoms being separate structures from said jacket, said jacket having at least one jacket opening passing through the jacket;

an inner tube arranged in the interior of housing, said jacket opening for connecting the inner tube to a tube of the exhaust system, wherein said jacket is segmented in a circumferential direction and comprises a jacket segment and a remaining jacket, said jacket segment being manufactured as a separate component in relation to said remaining jacket, said separate component jacket segment being rigidly connected to said remaining jacket and having said at least one jacket opening.

2. A muffler in accordance with claim 1, further comprising:

an intermediate bottom fastened from the inside to an inner side of said jacket segment, said inner side facing the interior of said housing.

3. A muffler in accordance with claim 2, wherein said intermediate bottom is welded from the inside to said inner side of said jacket segment.

4. A muffler in accordance with claim 2, wherein said intermediate bottom is attached to said remaining jacket from outside of said housing.

5. A muffler in accordance with claim 1, wherein said jacket segment has a collar formed integrally in one piece therewith, said collar projecting outside of said housing and bordering said jacket opening.

6. A muffler in accordance with claim 5, wherein the inner tube coaxially protrudes into the collar and said inner tube ends more or less flush with the collar.

7. A muffler in accordance with claim 5, wherein the inner tube is rigidly connected to the collar.

8. A muffler in accordance with claim 1, wherein the inner tube and the two end bottoms form a separately manufacturable insert, said separately manufacturable insert further comprising one of an intermediate bottom and an additional tube.

9. A muffler in accordance with claim 1, wherein said remaining jacket is manufactured from one piece; and said jacket segment is manufactured from one piece.

10. A muffler in accordance with claim 1, wherein the remaining jacket has circumferential ends having an outwardly stepped edge, said outwardly stepped edge overlaping each circumferential end of said jacket segment.

11. A muffler in accordance with claim 10, wherein the remaining jacket is rigidly connected to said jacket segment in an area of said stepped edges.

12. A muffler in accordance with claim 1, wherein circumferential ends of said jacket segment extend in a straight line, in parallel to or substantially in parallel to a longitudinal direction of said jacket.

13. A muffler in accordance with claim 1, wherein said jacket segment and said remaining jacket have one of different wall thicknesses and are manufactured from different materials.

14. A muffler in accordance with claim 1, wherein one of said jacket segment and said remaining jacket have stiffening beads, which extend in the circumferential direction.

15. A muffler in accordance with claim 4, wherein said intermediate bottom is attached to said remaining jacket by tack welds.

16. A muffler in accordance with claim 4, further comprising:

an internal arrangement having a longitudinal direction and a radial direction substantially perpendicular to said longitudinal direction, said internal arrangement being arranged inside said jacket for receiving, processing and discharging the exhaust gas;

said inner tube being directly and physically connected to at least one structure of said internal arrangement, said inner tube extending radially outward from said internal arrangement.

17. An exhaust component for processing exhaust gas from a combustion engine, the exhaust component comprising:

an internal arrangement having a longitudinal direction and a radial direction substantially perpendicular to said longitudinal direction, said internal arrangement receiving, processing and discharging the exhaust gas;

a radial tube directly and physically connected to at least one structure of said internal arrangement, said radial tube extending radially outward from said internal arrangement;

a first jacket segment mounted on said internal arrangement to cover a portion of said internal arrangement, said first jacket segment defining a jacket opening, said first jacket segment being mounted on said internal arrangement to have said radial tube extend through said jacket opening;

a second jacket segment mounted on said internal arrangement, said second jacket segment being connected to said first jacket segment to form a jacket that extends completely around said internal arrangement in a circumferential direction, said first jacket segment and said second jacket segment being shaped to completely cover said internal arrangement in said circumferential direction;

end pieces connected to said first and second jacket segments to close longitudinal ends of said jacket.

18. An exhaust component in accordance with claim 17, wherein:

said first jacket segment extends over said internal arrangement between 10% and 40% of an overall circumference of said jacket.

19. An exhaust component in accordance with claim 17, wherein:

said internal arrangement is directly and physically connected to said first jacket segment on a radial inside of said first jacket segment.

20. A process for forming an exhaust component that processes exhaust gas from a combustion engine, the process comprising the steps of:

providing an internal arrangement having a longitudinal direction and a radial direction substantially perpendicular to said longitudinal direction, said internal arrangement being for receiving, processing and discharging the exhaust gas;

providing a radial tube;

directly and physically connecting said radial tube to at least one structure of said internal arrangement to form a preassembled unit, said connecting of said radial tube arranging said radial tube to extend radially outward from said internal arrangement;

providing a first jacket segment defining a jacket opening;

mounting said first jacket segment on said internal arrangement to cover a portion of said internal arrangement, said first jacket segment being mounted on said internal arrangement to have said radial tube extend through said jacket opening;

providing a second jacket segment;

mounting said second jacket segment on said internal arrangement;

connecting said second jacket segment to said first jacket segment to form a jacket that extends completely around said internal arrangement in a circumferential direction;

said first jacket segment and said second jacket segment being shaped to completely cover said internal arrangement in said circumferential direction;

providing a plurality of end pieces;

connecting said end pieces to said first and second jacket segments to close longitudinal ends of said jacket formed by the connection of said first and second jacket segments.

21. A process in accordance with claim 20, wherein:

said jacket segment extends over said internal arrangement between 10% and 40% of an overall circumference of said jacket.

22. A process in accordance with claim 20, further comprising:

directly and physically connecting said internal arrangement to said first jacket segment on a radial inside of said first jacket segment.

23. A process in accordance with claim 20, further comprising:

welding said internal arrangement from the inside to an inner side of said first jacket segment, said inner side facing the interior of said jacket; and attaching said internal arrangement to said second jacket segment from outside by tack welds.

* * * * *